US005845833A

United States Patent [19]

Murphy

[11] Patent Number: 5,845,833

[45] Date of Patent: Dec. 8, 1998

[54] SHOULDER STRAP FOR A BAG

[76] Inventor: Kevin M Murphy, 20222 S. Normandie, Torrence, Calif. 90502

[21] Appl. No.: 978,988

[22] Filed: Nov. 26, 1997

[51] Int. Cl.[6] ..... A45F 3/02

[52] U.S. Cl. ..... 224/625; 224/607

[58] Field of Search ..... 224/646, 642, 224/607, 575, 578, 579, 580, 623, 624, 625, 610, 611, 612, 264, 637

[56] References Cited

U.S. PATENT DOCUMENTS 4,887,751 12/1989 Lehman ..... 224/579

5,129,564 7/1992 Danezin ..... 224/578

*Primary Examiner*—David J. Walczak

*Attorney, Agent, or Firm*—James G. O'Neill

[57] ABSTRACT

A shoulder strap includes a separate belt extendable from and retractable into one end of the shoulder strap upon movement of a sheath, covering a predetermined length of the belt and one end of the shoulder strap. The shoulder strap and the extended separate belt may then be supported on the shoulders of a person to support a bag suspended from the ends of the shoulder strap. The sheath may be made so as to be openable or foldable to allow extension of the separate belt.

20 Claims, 2 Drawing Sheets

SHOULDER STRAP FOR A BAG

BACKGROUND OF THE INVENTION

1. Field of the Invention

This invention relates generally to shoulder straps, and more particularly, to an improved shoulder strap for a bag.

2. Description of Related Art

Shoulder straps for bags, such as briefcases, carrying cases, purses, suitcases, and the like, are specifically designed so as to be fastened to opposite ends of the bag for supporting the bag on either shoulder of an individual. Such straps usually include an enlarged pad, or slidable portion thereon, to provide additional support while on a person's shoulder. However, as is well known, if a person attempts to carry more than one bag, or a bag and other items, known shoulder straps, easily slip off the user's shoulder, and tend to oscillate or swing about, in an uncontrolled manner. Additionally, known shoulder straps are easily torn off the shoulder of a person by a determined thief. Therefore, there exists a need in the art for an improved shoulder strap, which strap provides additional control and support for a bag, and which includes means to prevent the strap from slipping or being dislodged from a user's shoulder during awkward or hurried moments, or by a thief.

It is also known to provide shoulder holsters for guns, or other weapons worn by peace officers and other authorized or licensed personnel. Such shoulder holsters usually include a number of straps supporting the actual weapon carrier or holster in a desired position, from both shoulders of a person. These shoulder holder straps are normally adjusted and then locked in position over a user's shoulders and back, in a known manner. After being adjusted, the straps of such known shoulder holsters are maintained in the desired position and not usually moved. However, the straps on known shoulder holsters cannot be adapted to hold and/or support a bag, normally carried at a user's side.

SUMMARY OF THE INVENTION

It is, therefore, a general object of the present invention to provide an improved strap for supporting a bag. It is a more particular object of the present invention to provide an improved shoulder strap for supporting a bag carried by a person. It is a still more particular object of the present invention to provide an improved shoulder strap having a second strap secured thereto, which may be looped over and supported by the shoulder opposite that on which the user mounts the shoulder strap. It is yet another object of the present invention to provide a unique shoulder strap for a bag, having a foldable sheath thereon, which sheath allows a retractable belt, held in the sheath, to be withdrawn and worn by a user. It is a still further particular object of the present invention to provide a unique shoulder strap having two ends, and a second strap held therein, which second strap is held between one side of a shoulder pad and a holder secured within a movable sheath.

In accordance with one aspect of the present invention, there is provided a novel shoulder strap having two ends with means for securing the shoulder strap to a bag on each of the two ends. A belt is secured to the shoulder strap in such a manner that the belt may be pulled from a retracted position, adjacent one end of the shoulder strap, to an extended position where the belt may be looped over a second shoulder of a user, opposed to the shoulder supporting the shoulder strap. When not in use, the belt is held in a retracted position, within a sheath.

BRIEF DESCRIPTION OF THE DRAWINGS

The objects and features of the present invention, which are believed to be novel, are set forth with particularity in the appended claims. The present invention, both as to its organization and manner of operation, together with further objectives and advantages, may be best understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved shoulder strap 10 to aid a person in carrying a bag, indicated generally at 12.

Figure 2:
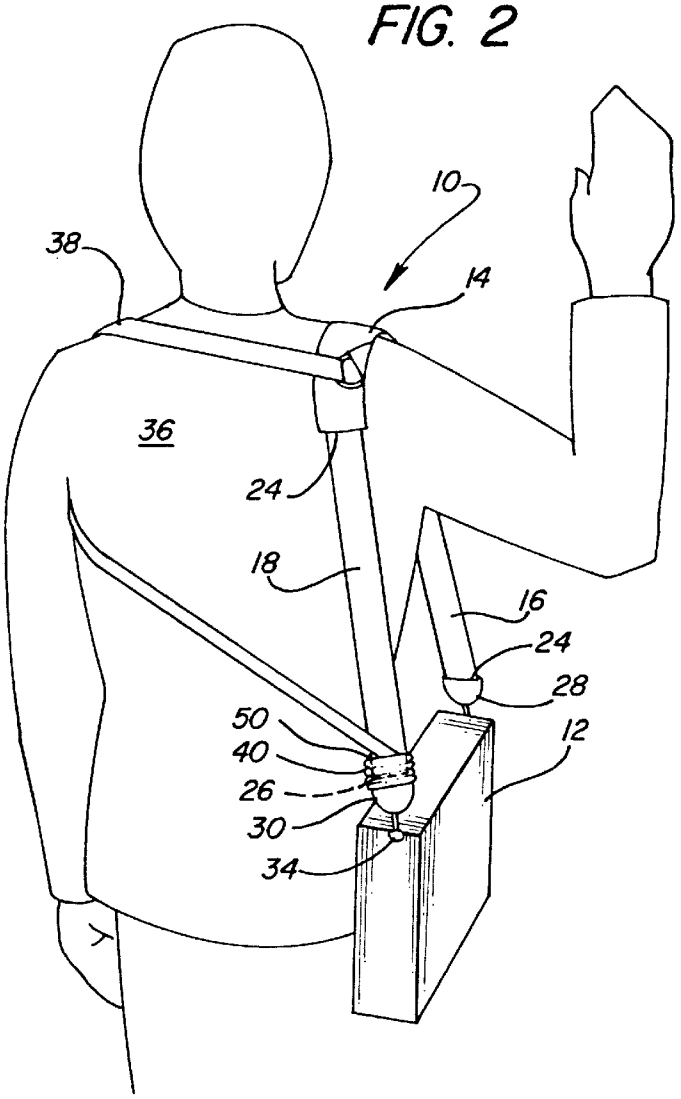
FIG. 2 is a further perspective view of the shoulder strap and bag of FIG. 1 held on the shoulders of a user.
Figure 1:
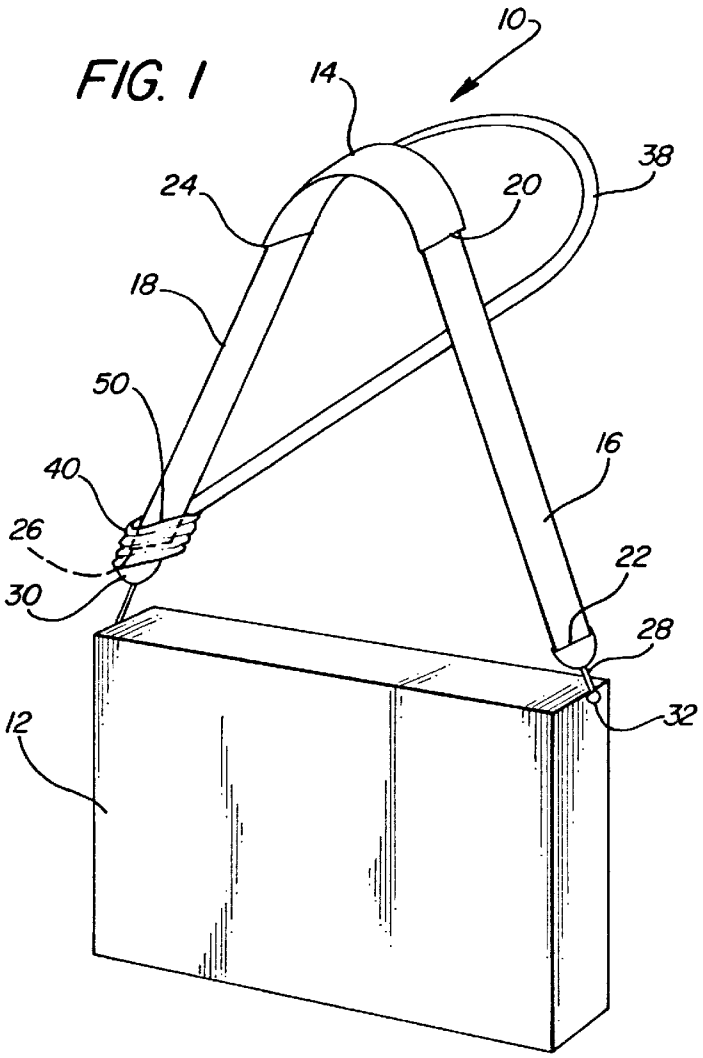
FIG. 1 is a perspective view of one embodiment of the shoulder strap of the present invention, with the free ends of the shoulder strap attached to a bag, and showing a separate, extended belt for looping over a further shoulder of a user.

Turning first to FIGS. 1 and 2, there shown is the improved shoulder strap 10, secured to the bag 12. The shoulder strap may be made from any desired material, such as leather, nylon webbing, and/or a combination thereof, or other materials, in any desired length and width. The shoulder strap 10 includes a central shoulder pad 14, secured at opposite ends to a pair of elongated sections or strap portions 16, 18. Each of the elongated strap portions 16, 18 may be of any desired length, and may include a means for adjusting the length thereof, of a type well known to those skilled in the art. Each strap portion includes two ends 20, 22 and 24, 26 respectively. The first or fixed end 20, 24 of each elongated strap portion is secured to an end of the shoulder pad 14, in any desired manner, as by being sewn thereto. The second or free end 22, 26 of each strap portion is secured to or around bag holding or hooking elements 28, 30, of a type well known to those skilled in the art. These bag holding or hooking elements 28, 30 may be removably secured to D-ring or other securing arrangements 32, 34 held on opposite ends of the bag 12, to enable the bag 12 to be supported on a first shoulder of a user 36 (such as shown in FIG. 2), by the shoulder strap 10.

The shoulder strap 10 of the present invention also includes a separate belt or strap 38, secured thereon. This separate belt 38 is preferably narrower than strap portions 16, 18, for example, approximately one-half the width, and includes a fixed or secured end and a movable or slidable end. The movable end is normally held in a withdrawn or retracted position, with belt 38 against strap portion 18, and within a cover or sheath 40. However, if the belt 38 is pulled outwardly from strap 18, while sliding the sheath 40 to a lowered or folded position, as shown in FIGS. 1 and 2, the belt 38 is withdrawn or extended outwardly to a position where the belt 38 may be looped over an opposite arm, and worn over the back and other, or second shoulder of the user 36. As best shown in FIG. 2, this belt 38 adds further security, stability and support to the bag 12, when carried by the user.

Figure 4:
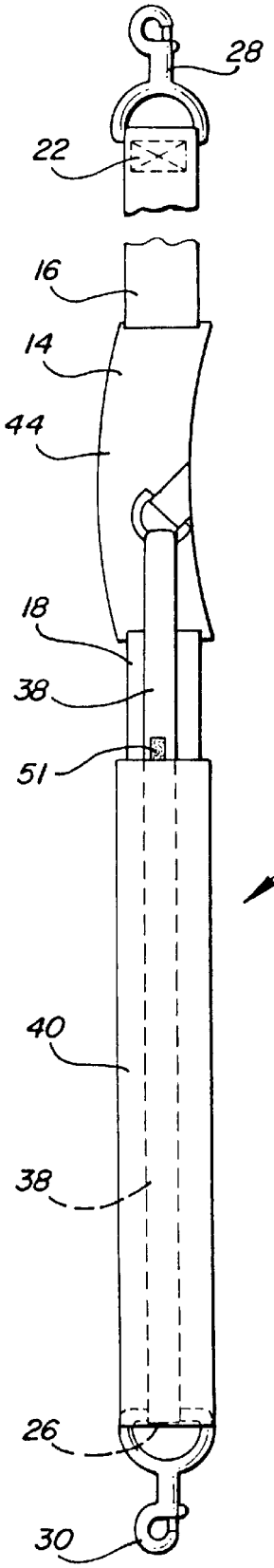
FIG. 4 is a bottom plan view of the shoulder strap of FIG. 3.
Figure 3:
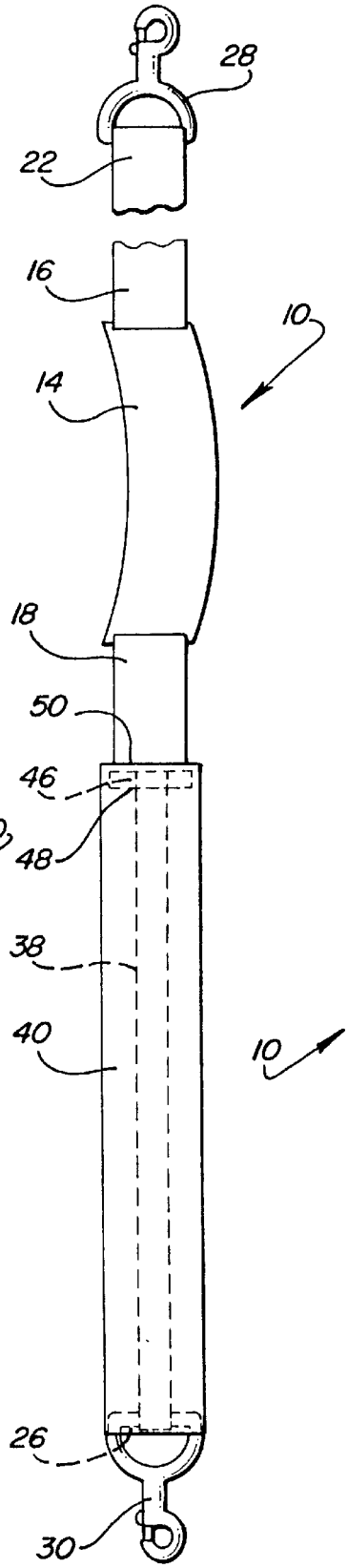
FIG. 3 is a top plan view of the shoulder strap of the present invention in a flattened position, with the separate belt in the retracted position inside a sheath.
Figure 5:
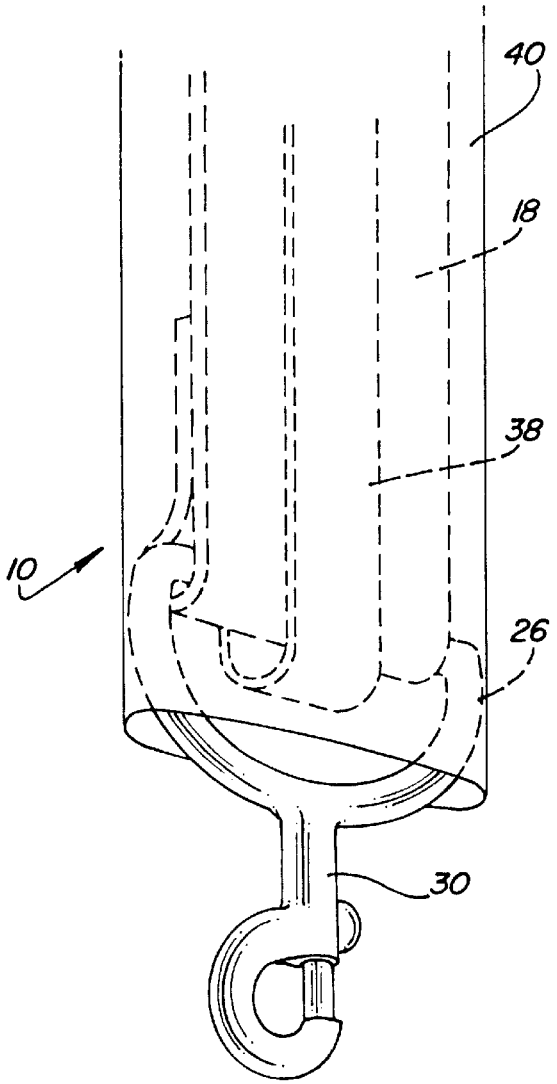
FIG. 5 is an enlarged, partial perspective view of one end of the shoulder strap of FIG. 3, showing the details of how the separate belt is held in the retractable sheath, and loops around one end of the shoulder strap.

As shown more clearly in FIGS. 3 through 5, the belt 38 is sized and dimensioned so as to be narrower than strap portion 18 and to have sufficient length that a first or secured end 41 is held in securing means 42, such as a D-ring, held on a first or exterior surface 44 of shoulder pad 14. The belt 38 then extends down or along a first side of elongated strap 18, is bent or looped around end 26 through hook elements 30, and then extends up the other or second side of elongated strap 18, until it reaches a second movable end 46. The second end 46 may be secured to a holder 48, such as a bar, cross-arm or fastener held within a movable or slidable end 50 of sheath 40, or releasably held by a suitable fastener, such as a loop and hook arrangement to the second side of the elongated strap portion 18. If releasably secured to the elongated strap portion 18, the end 46 would includes a stop, such as an arm or D-ring larger than the opening in the holding element 30, so that the end 46 of strap 38 could not pass the holding element 30, when extended. Additionally, the cover or sheath 40 would include an opener, such as a zipper, or the like, therein, to enable the sheath 40 to be spread apart so that the end 46 could be released from the second side of the elongated strap portion, and extended or withdrawn from within the cover 40.

From the above description, it can be seen that after the sheath is opened or a retainer 51 is released, the sheath is spread apart and the end 46 of belt 38 released, or the end 50 of sheath 40 is moved or slid from the fully extended position shown in FIGS. 3 through 5, to the lowered or folded position shown in FIGS. 1 and 2, in an accordion-type fashion. At the same time, the belt 38 will be pulled around end 26 of elongated strap 18 until the belt 38 is fully extended away from strap portion 18 (see FIG. 1). When it is no longer desired to use the belt 38, either of the above described procedures will be reversed, and the belt 38 and cover or sheath 40 returned to the position shown in FIGS. 3 and 4. For example, the end 50 of the sheath 40, with attached end 46 of belt 38 and cross bar 48 will be pulled upwardly to the extended position shown in FIGS. 3 and 4, thereby pulling the loose or extended portion of the belt 38 into the sheath and around end 26 of elongated strap 18, until the sheath 40 and belt 38 are in the fully raised or closed position. The sheath 40 may then be closed, if spread apart, or held in position by securing the retainer 51 to the belt 38. The retainer 51 may comprise a loop and hook type fastener, or any other type of releasable fastener which secures the movable end 50 of the sheath to the belt 38.

It, therefore, can be seen that the unique combination shoulder strap and support belt of the present invention provides a novel strap which allows a person to more safely and securely support a bag by both of their shoulders.

Those skilled in the art will appreciate the various adaptations and modifications of the just-described preferred embodiments can be configured without departing from the scope and spirit of the invention. Therefore, it is to be understood that, within the scope of the appended claims, the invention may be practiced other than is specifically described herein.

What is claimed is:

1. A shoulder strap for a bag comprising; in combination:

a shoulder pad;

a pair of elongated strap portions; each of the pair of elongated strap portions having two ends; each of the pair of elongated strap portions being secured to the shoulder pad by a first of the two ends;

means for securing a bag held on each of the pair of elongated strap portions at a second of the two ends;

a separate belt retractably carried on one of the pair of elongated strap portions; and a cover associated with the separate belt, which cover must be moved to allow the separate belt to be moved between retracted and extended positions wherein said separate belt remains carried on said one of said strap portions in both of said retracted and extended positions.

2. The shoulder strap of claim 1 wherein the cover comprises a hollow sheath surrounding the one of the pair of elongated strap portions, and the separate belt.

3. The shoulder strap of claim 2 wherein the separate belt has a first end and a second end, with the first end secured to the shoulder pad and the second end secured under the hollow sheath.

4. The shoulder strap of claim 3 wherein the second end is secured to a holding element.

5. The shoulder strap of claim 4 wherein the separate belt is looped over the second of the two ends of the one of the pair of elongated strap portions.

6. The shoulder strap of claim 5, further including a retainer for holding the hollow sheath in a closed, extended position.

7. The shoulder strap of claim 1 wherein the separate belt has a first end and a second end, with the first end secured to a first side of the shoulder pad.

8. The shoulder strap of claim 7 wherein the second end of the separate belt is secured under the hollow sheath.

9. The shoulder strap of claim 8 wherein the hollow sheath covers a holder, which holder is secured to the second end of the separate belt, and the separate belt is looped over the second of the two ends of the one of the pair of elongated strap portions to which it is adjacent.

10. The shoulder strap of claim 9 wherein the hollow sheath surrounds a portion of the one of the pair of elongated strap portions and the separate belt, and the holding element is secured to the hollow sheath.

11. The shoulder strip of claim 10, further including a retainer secured to the hollow sheath, and cooperating with the separate belt to lock the hollow sheath and the separate belt in closed positions.

12. A combination shoulder strap and bag with the shoulder strap having two free ends secured to the bag by a pair of holding elements held at the two free ends; the shoulder strap comprising, in combination:

a first elongated strap portion having a first end and a second end and a second elongated strap portion having a first end and a second end; the first elongated strap portion and the second elongated strap portion being secured to a shoulder pad by the second end thereof;

the first end of the first elongated strap portion and the first end of the second elongated strap portion extending away from the shoulder pad, and having one of the pair of bag holding elements thereon; and a separate belt retactably held on the first elongated strap portion; the separate belt including a fixed end secured to one side of the shoulder pad and a movable end secured in a sheath surrounding a predetermined length of the first elongated strap portion and the separate belt.

13. The combination shoulder strap and bag of claim 12 wherein the separate belt is extendable from a closed position to an extended position, and is sized and dimensioned so that while it is in an extended position, it will fit over a first shoulder of a person carrying the bag, while the shoulder strap is held on a second shoulder of the person carrying the bag.

14. The combination shoulder strap and bag of claim 12 wherein the movable end of the separate belt is secured to a further holding element, held under the sheath.

15. The combination shoulder strap and bag of claim 14 wherein the separate belt is extendable from a closed position to an extended position, and the separate belt is sized and dimensioned so that it extends from the fixed end secured to the one side of the shoulder pad, around the outer end of the first elongated strap portion, adjacent one of the pair of bag holding elements secured to the outer end, and to the further holding element held within the sheath.

16. The combination shoulder strap and bag of claim 12 wherein the sheath includes a secured end and a slidable end, and is capable of being folded toward the secured end, while the separate belt is extendable from a closed position within the sheath to an extended position exterior to the sheath.

17. A shoulder strap for a bag comprising, in combination:

a shoulder pad having a first end and a second end;

a first elongated strap portion having a fixed end and a free end, with the fixed end being secured to the first end of the shoulder pad, and the free end being secured to a first bag supporting element;

a second elongated strap portion having a fixed end and a free end, with the fixed end being secured to the second end of the shoulder pad, and the free end being secured to second bag supporting element;

an elongated belt having a first secured end held to a first side of the shoulder pad and a second movable end;

a hollow sheath mounted on and surrounding the second elongated strap portion and the elongated belt for a predetermined distance; the hollow sheath having a first slidable end, movable along the second elongated strap portion and a second secured end, secured to the second elongated strap portion at the free end thereof; and the hollow sheath being slidable between an extended position with the elongated belt held therein and a folded position with the elongated belt withdrawn therefrom.

18. The shoulder strap for a bag of claim 17, further including a releasable retainer held on the first slidable end of the hollow sheath, and cooperating with the elongated belt when the hollow sheath is in the extended position.

19. The shoulder strap for a bag of claim 17, further including a holding element held in the first slidable end of the hollow sheath, and secured to the second movable end of the elongated belt.

20. The shoulder strap for a bag of claim 19 wherein the elongated belt is looped over the free end of the second elongated strap portion.

* * * * *